US008602292B2

(12) United States Patent
Brand

(10) Patent No.: US 8,602,292 B2
(45) Date of Patent: Dec. 10, 2013

(54) CARTON WITH REINFORCED HANDLE

(75) Inventor: Kirsten Laura Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 1863 days.

(21) Appl. No.: 11/557,672

(22) Filed: Nov. 8, 2006

(65) Prior Publication Data

US 2007/0131748 A1 Jun. 14, 2007

Related U.S. Application Data

(60) Provisional application No. 60/734,504, filed on Nov. 8, 2005.

(51) Int. Cl.

| | |
|---|---|
| ***B65D 17/00*** | (2006.01) |
| ***B65D 5/46*** | (2006.01) |
| ***B65D 5/00*** | (2006.01) |

(52) U.S. Cl.

USPC ..... 229/117.16; 229/117.17; 229/103.2; 229/242

(58) Field of Classification Search

USPC ..... 229/117.16, 117.17, 103.2, 242

See application file for complete search history.

(56) References Cited

U.S. PATENT DOCUMENTS

| | | | | |
|---|---|---|---|---|
| 2,196,502 | A | | 4/1940 | Kells |
| 2,308,050 | A | | 1/1943 | Burr |
| 2,386,905 | A | | 10/1945 | Meitzen |
| 2,648,484 | A | * | 8/1953 | Belsinger ..... 229/117.17 |
| 2,900,123 | A | | 8/1959 | Drnec et al. |
| 3,173,596 | A | | 3/1965 | Aust et al. |
| 3,756,499 | A | | 9/1973 | Giebel et al. |
| 4,005,815 | A | | 2/1977 | Nerenberg et al. |
| 4,538,759 | A | | 9/1985 | Dutcher |
| 4,621,766 | A | | 11/1986 | McClure |
| 5,072,876 | A | | 12/1991 | Wilson |
| 5,119,985 | A | | 6/1992 | Dawson et al. |

(Continued)

FOREIGN PATENT DOCUMENTS

| | | |
|---|---|---|
| EP | 0870688 A1 | 10/1998 |
| JP | 3-84717 | 8/1991 |
| WO | WO 99/28198 | 6/1999 |

OTHER PUBLICATIONS

Japanese Office Action for related JP application No. JP 2008-540129, mailed Jun. 29, 2011.

*Primary Examiner* — Nathan J Newhouse
*Assistant Examiner* — Latrice Byrd
(74) *Attorney, Agent, or Firm* — Womble Carlyle Sandridge & Rice, LLP

(57) ABSTRACT

A carton for containing a plurality of articles. The carton has a plurality of panels that extend at least partially around an interior of the carton. The plurality of panels include a top panel, a bottom panel, a first side panel, and a second side panel. At least two end flaps are respectively foldably attached to respective panels of the plurality of panels. The end flaps are overlapped with respect to one another and thereby at least partially form a closed end of the carton. The carton includes a handle in the closed end of the carton having a handle opening for grasping and carrying the carton. At least one end flap of the at least two end flaps has a main panel for at least partially closing the closed end of the carton and a reinforcement panel foldably attached to the main panel.

29 Claims, 5 Drawing Sheets

(56) References Cited

U.S. PATENT DOCUMENTS

| | | | | |
|---|---|---|---|---|
| 5,350,109 | A | 9/1994 | Brown et al. | |
| 5,588,585 | A * | 12/1996 | McClure | 229/191 |
| 6,112,977 | A | 9/2000 | Sutherland et al. | |
| 6,170,741 | B1 | 1/2001 | Skolik et al. | |
| 6,250,542 | B1 | 6/2001 | Negelen | |
| 6,595,411 | B2 | 7/2003 | McClure | |
| 6,631,803 | B2 | 10/2003 | Rhodes et al. | |
| 6,766,940 | B2 | 7/2004 | Negelen | |
| 6,848,573 | B2 | 2/2005 | Gould et al. | |
| 6,968,992 | B2 | 11/2005 | Schuster | |
| 7,757,933 | B2 | 7/2010 | Dunn | |
| 7,775,418 | B2 | 8/2010 | Walling | |
| 7,780,067 | B2 | 8/2010 | Holley, Jr. | |
| 7,832,622 | B2 | 11/2010 | Spivey, Sr. | |
| 2005/0087592 | A1 | 4/2005 | Schuster | |
| 2005/0189405 | A1 | 9/2005 | Gomes et al. | |
| 2005/0263574 | A1 | 12/2005 | Schuster | |
| 2006/0081691 | A1 * | 4/2006 | Smalley | 229/103.2 |
| 2006/0278689 | A1 * | 12/2006 | Boshinski et al. | 229/117.16 |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2010/0025457 | A1 | 2/2010 | Cooper et al. | |

* cited by examiner

CARTON WITH REINFORCED HANDLE

CROSS-REFERENCE TO RELATED APPLICATIONS

This application claims the benefit of U.S. Provisional Application No. 60/734,504, filed on Nov. 8, 2005, the entire contents of which are hereby incorporated by reference as if presented herein in their entirety.

BACKGROUND OF THE INVENTION

The present invention generally relates to cartons for holding and dispensing beverage containers or other types of articles. More specifically, the present invention relates to cartons having a reinforced handle.

Cartons, such as paperboard cartons used to hold, carry or dispense articles are well known. These cartons usually are formed or assembled by folding a paperboard carton blank that has been cut, perforated and creased in selected areas to achieve desired features and characteristics. These features include tear lines, handles, opening features, dispensers and other well-known attributes. Such handle features can be formed, for example, in the top panel or alternatively in an end or ends of the carton. These handles can define a hole or other opening to permit the handle to be grasped by the user so that the loaded carton can be conveniently carried via the handle.

When fabricating a carrier or carton from the paperboard carton blank, it is common for opposite ends of the blank to be attached to each other by glue or by mechanical locks to form the bottom panel of the carrier. End flaps are included on sides of some or all panels and are folded inwardly to close the ends of the carton and enclose articles, such as beverage containers, therewithin. These end flaps can contain opening or dispensing features or can include handles for carrying the carton. These handles often create problems when, for example, the handle opening weakens and/or tears the paperboard or other material of the carton.

SUMMARY OF THE INVENTION

In general, one aspect of the invention is directed to a carton for containing a plurality of articles. The carton comprises a plurality of panels that extend at least partially around an interior of the carton. The plurality of panels comprises a top panel, a bottom panel, a first side panel, and a second side panel. At least two end flaps are respectively foldably attached to respective panels of the plurality of panels, wherein the end flaps are overlapped with respect to one another and thereby at least partially form a closed end of the carton. The carton includes a handle in the closed end of the carton having a handle opening for grasping and carrying the carton. At least one end flap of the at least two end flaps comprises a main panel for at least partially closing the closed end of the carton and a reinforcement panel foldably attached to the main panel for cooperating with the main panel to form the handle opening.

In another aspect, the invention is generally directed to a blank for forming a carton. The blank comprises a plurality of panels comprising a top panel, a bottom panel, a first side panel, and a second side panel. At least two end flaps are respectively foldably attached to respective panels of the plurality of panels. Features are in the at least two end flaps, wherein the features are for cooperating to at least partially define a handle opening in a carton erected from the blank. At least one end flap of the at least two end flaps comprises a main panel for at least partially closing an end of the carton erected from the blank and a reinforcement panel foldably attached to the main panel. The reinforcement panel and the main panel have respective features for at least partially forming the handle opening.

In another aspect, the invention is generally directed to a method of assembling a carton. The method comprises providing a carton comprising a plurality of panels comprising a top panel, a bottom panel, a first side panel, and a second side panel, at least one side end flap foldably attached to at least one of the side end panels at a first end of the carton, at least one top end flap foldably attached to the top panel at the first end, and a handle formed at least in part in the top end flap and the at least one side end flap. The at least one side end flap comprising a main panel for at least partially forming a closed end of the carton, and a reinforcement panel foldably attached to the main panel. The method further comprises folding the at least one side end flap to at least partially close the first end of the carton. The method further comprises folding the second reinforcement panel upward to at least partially overlap the main panel of the side end flap during the at least partially closing of the first end to at least partially form the handle. The method further comprises securing the top end flap in a downwardly folded position to at least partially form the closed first end of the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., plastic beverage bottles) as disposed within the carton embodiments. In this specification, the terms "lower," "bottom," "upper" and "top" indicate orientations determined in relation to fully erected and upright cartons.

Figure 1:
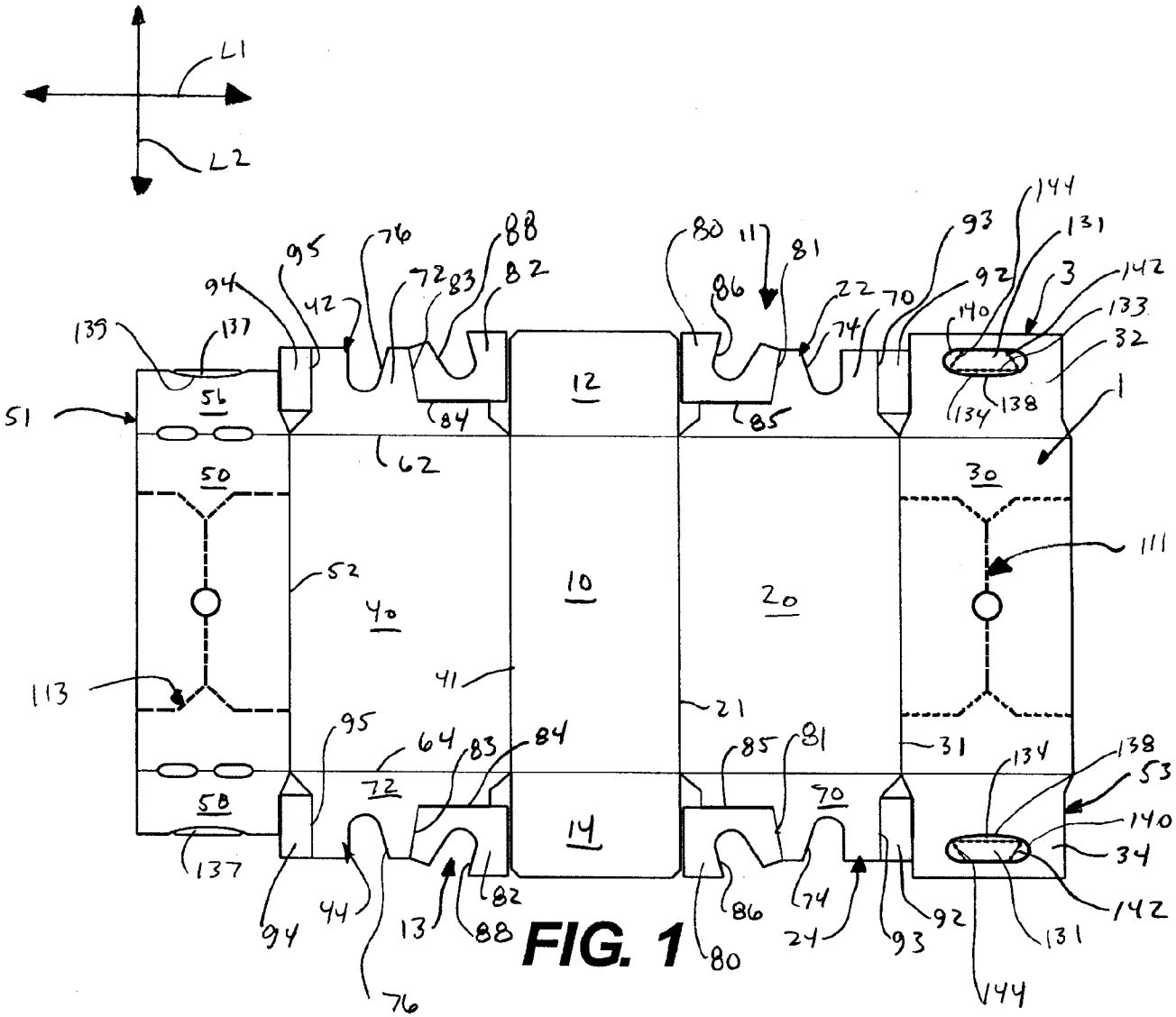
FIG. 1 is a plan view of a blank used to form a carton according to a first embodiment of the invention.
Figure 2:
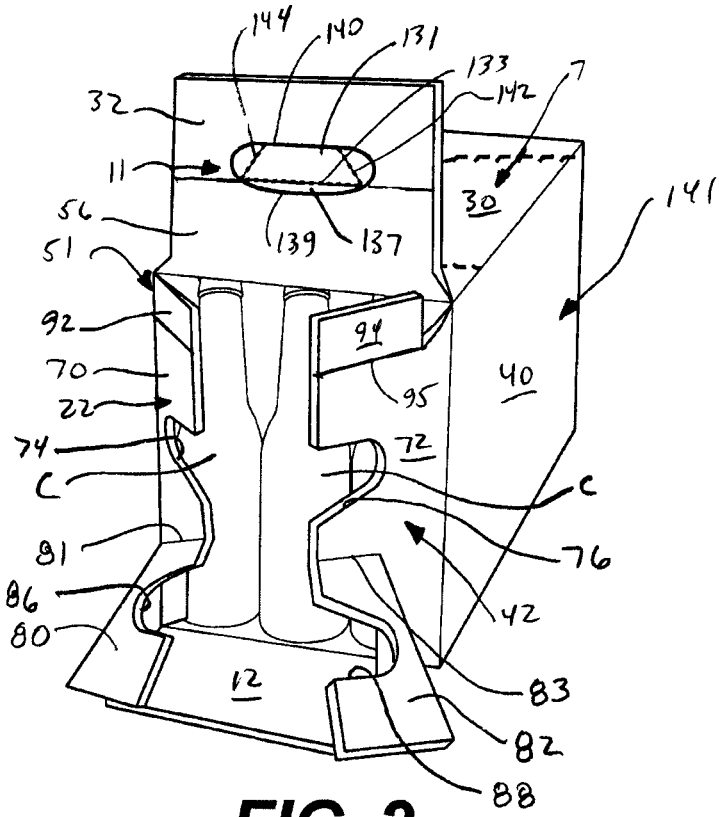
FIG. 2 is a perspective of the carton in a partially assembled condition showing a first end of the carton and containers loaded in the carton.

FIG. 1 is a plan view of the interior side 1 of a blank, generally indicated at 3, used to form a carton 5 (FIGS. 6 and 7) according to the exemplary embodiment of the invention. The carton 5 can be used to house a plurality of articles such as containers C (FIG. 2). The carton 5 has a dispenser, generally indicated at 7 (FIG. 6), formed in the carton for allowing access to the containers C. In the illustrated embodiment, the carton 5 is sized to house eighteen containers C in a single layer in a 3×6 arrangement, but the carton 5 may be sized and shaped to hold containers of a different or same quantity in more than one layer and/or in different row/column arrangements (e.g., 1×6, 3×5, 2×6×2, 3×4×2, 2×9, 2×6, 3×4, etc.). In the illustrated embodiment, the carton 5 includes a first and second handle, generally indicated at 11, 13, for grasping and carrying the carton. As will be discussed below in more detail, the handles 11, 13 are formed from various features in the blank 3.

The blank 3 has a longitudinal axis L1 and a lateral axis L2. In the illustrated embodiment, the blank 3 comprises a bottom panel 10 foldably connected to a first side panel 20 at a first lateral fold line 21, a first top panel 30 foldably connected to the first side panel 20 at a second lateral fold line 31, a second side panel 40 foldably connected to the bottom panel 10 at a third lateral fold line 41, and a second top panel 50 foldably connected to the second side panel 40 at a fourth lateral fold line 52. The blank 3 could include only a single top panel without departing from the scope of this invention.

The bottom panel 10 is foldably connected to a first bottom end flap 12 and a second bottom end flap 14. The first side panel 20 is foldably connected to a first side end flap 22 and a second side end flap 24. The first top panel 30 is foldably connected to a first top end flap 32 and a second top end flap 34. The second side panel 40 is foldably connected to a first side end flap 42 and a second side end flap 44. The second top panel 50 is foldably connected to a first top end flap 56 and a second top end flap 58.

The top and bottom end flaps 12, 32, 56 and side end flaps 22, 42 extend along a first marginal area of the blank 3, and are foldably connected at a first longitudinal fold line 62 that extends along the length of the blank. The top and bottom end flaps 14, 34, 58 and side end flaps 24, 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors. When the carton 5 is erected, the top and bottom end flaps 12, 32, 56 and side end flaps 22, 42 close a first end 51 of the carton, and the top and bottom end flaps 14, 34, 58 and side end flaps 24, 44 close a second end 53 of the carton. In accordance with an alternative embodiment of the present invention, different flap arrangements can be used for closing the ends 51, 53 of the carton 5.

In the illustrated embodiment, the first side end flaps 22, 42 each comprise a main panel 70, 72 having a cutout 74, 76 formed in an outer edge of the respective end flap. The first side end flaps 22, 42 include a reinforcing panel 80, 82 foldably attached to a respective main panel 70, 72 at a fold line 81, 83. A longitudinal slit 84, 85 separates a respective reinforcing panel 80, 82 from a respective main panel 70, 72 of the first side end flaps 22, 42. Each reinforcing panel 80, 82 has a cutout 86, 88 formed in an outer edge of a respective first side end flap 22, 42. Each first side end flap 22, 42 has an extension panel 92, 94 foldably connected to a respective main panel 70, 72 along a respective lateral fold line 93, 95. The second side end flaps 24, 44 are similar in shape and construction as the first side end flaps 22, 42, and identical features have been given the same reference numbers for ease of illustration.

The dispenser 7 includes a dispenser panel 107 formed in the overlapped first and second top panels 30, 50 that is separable from the carton 5 along a tear line, generally indicated 109 to form an opening (not shown) in the carton. The tear line 109 includes a first portion 111 in the first top panel 30 and a second portion 113 in the second top panel 50. The dispenser 7 includes a finger panel 115 in the overlapped first and second top panels 30, 50 that is foldable inward of the assembled carton 5 for grasping of the dispenser panel 107. The dispenser 7 can be opened by grasping the finger panel 115 and tearing the dispenser panel 107 along the tear line 109 to at least partially remove the dispenser panel and expose the top portion of the containers C in the carton 5 to allow removal of the containers from the carton. The dispenser 7 may be otherwise sized, shaped, and/or located in the carton 5 without departing from the scope of this invention. Further, the dispenser 7 may be omitted from the carton 5 without departing from the scope of the invention.

As shown in FIG. 1, the features that form the first handle 11 of the carton 5 include an elongate handle flap 131 formed in the first top end flap 32 and foldably attached to the first end flap 32 at fold line 133. In the illustrated embodiment, the features of handle 11 include an elongate comfort panel 134 adjacent the handle flap 131 and foldably attached to the first top end flap 32 at a fold line 138. The fold line 138 connects respective ends of a tear line 140 that form the handle flap 131 in the first top end flap 32. In the illustrated embodiment, the handle flap 131 includes two spaced apart oblique fold lines 142, 144 extending across the width of the flap 131. The top end flap 56 includes a comfort panel 137 foldably attached to the top end flap at a fold line 139. The comfort panel 137 is sized and shaped to correspond with the comfort panel 134 of the first top end flap 32 so that the two comfort panels overlap when the first and second top panels 30, 50 are overlapped to form the carton 5.

The features of the first handle 11 further include respective curved cutouts 74, 76, 86, 88 in the end flaps 22, 42 to allow the elongate handle flap 131 to fold inwardly when the handle is activated to form a handle opening 139 (FIG. 7) in the carton. As shown in FIGS. 2-5, the features of the handle 11 also include the reinforcing panels 80, 82 that are shaped to be folded upwardly along fold lines 81, 83 to overlap the main panels 70, 72 so that the cutouts 86, 88 in the reinforcing panels are aligned with the cutouts 74, 76 in the main panels. An additional feature of the handle 11 is the positioning of the extension panels 92, 94 that are downwardly folded about respective fold lines 93, 95 so as to overlap the upwardly folded reinforcing panels 80, 82 above the cutouts 74, 76, 86, 88 in the handle 11. The elongate handle flap 131 is shaped and positioned in the blank 3 so that the handle 11 is activated by pressing on the handle flap and folding the handle flap inward into the curved cutouts 74, 76, 86, 88 to form the handle opening 139 in the carton 5. The opening is shaped for insertion of a user's fingers during grasping of the carton 5. The comfort panels 134, 137 are shaped to fit a user's hand to facilitate grasping of the carton 5 when the user's fingers are inserted into the handle opening 139.

Figure 7:
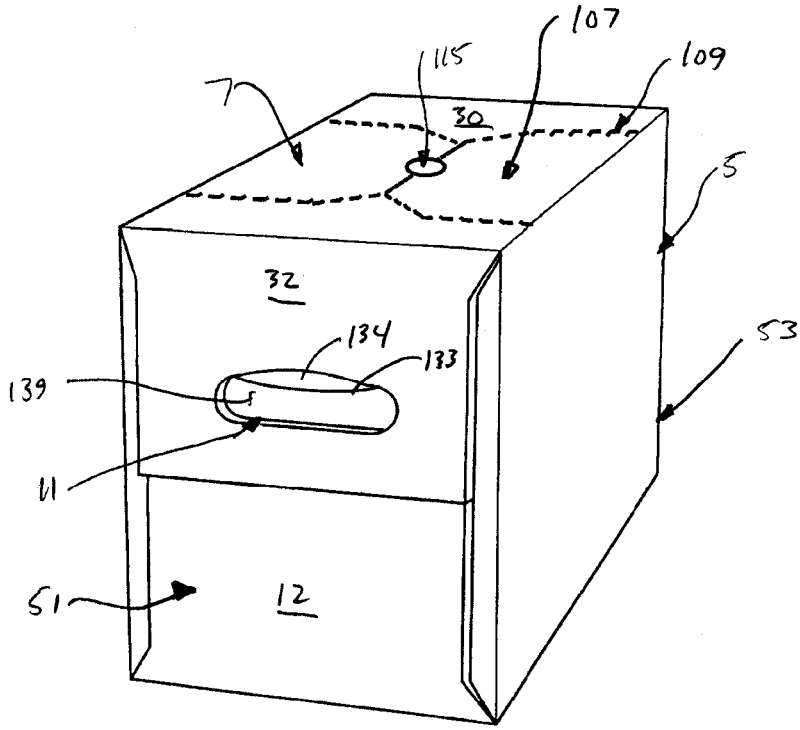
FIG. 7 is a view similar to FIG. 6 but showing a handle opening in the first end of the carton.
Figure 8:
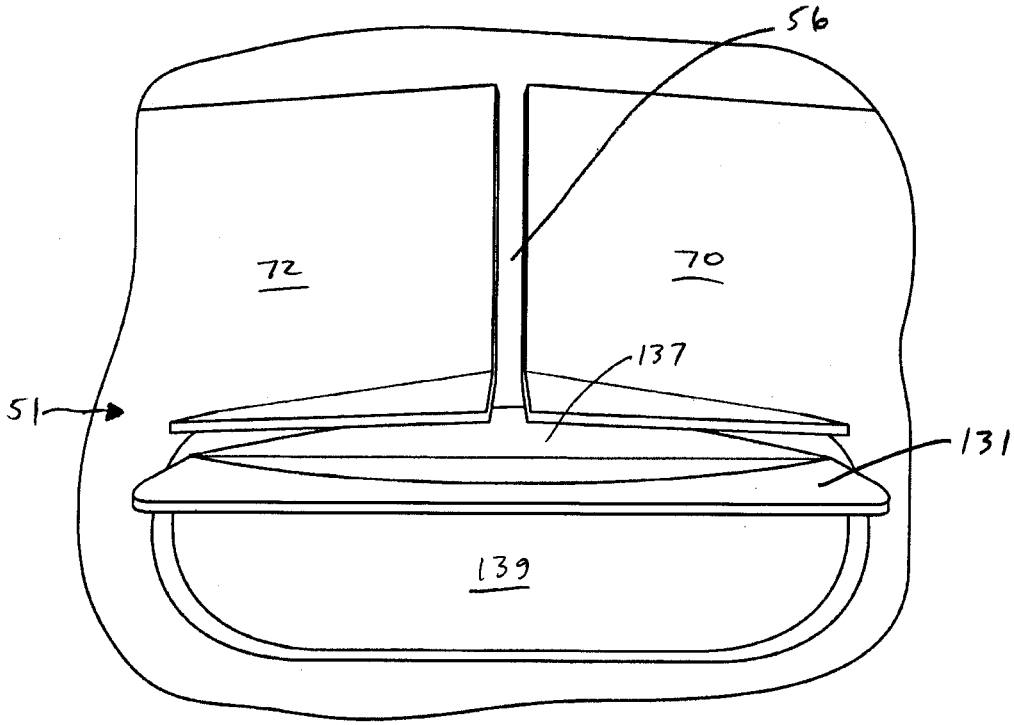
FIG. 8 is an enlarged partial view from the interior of the carton showing the handle opening.

In the illustrated embodiment, when the carton 5 is closed and the first handle 11 activated for grasping of the carton 5 (FIG. 7), the handle flap 131 is folded inward along fold line 133, further from the position shown in FIG. 8, to be in opposing face-to-face relation with the interior surface of a respective upper portion of the side panel end flaps 22, 42. The downwardly folded extension panels 92, 94 and upwardly folded reinforcing panels 80, 82 provide the first handle 11 with additional strength to prevent failure of the carton in the area around the handle opening 139 when the carton is grasped and lifted at the handle. The first handle 11 may be otherwise shaped and located in the carton 5 and may include other features not shown or described herein without departing from the scope of this invention.

The second handle 13 has features identical to the first handle 11 so that the second handle may be grasped for lifting the carton at the second end 53. The features of the second handle 13 have been given the same reference numbers as noted above for the features of the first handle 11. The second handle 13 could have features that vary from the features of the first handle 11, or the second handle can be omitted, without departing from the scope of this invention.

In accordance with the exemplary embodiment, the blank 3 can be erected into the carton 5 by folding along fold lines 21, 31, 41, and 52 and overlapping and adhering the first top panel 30 to the second top panel 50 to form a sleeve 141 (shown partially closed in FIG. 2). The blank 3 can be otherwise configured to have multiple bottom panels and/or multiple side panels without departing from the scope of this invention. Further, the carton 5 may be a wrap-around type carton, with the blank 3 including locking features that can include primary and secondary locking features as is known in the art.

Once the blank 3 is formed into the sleeve 141, the containers C may be loaded in the carton 5 from the first end 51 and then the first end may be closed by overlapping and gluing the side end flaps 22, 42 and top and bottom end flaps 32, 56, 12. Next, the second end may be closed by overlapping and gluing the side end flaps 24, 44 and top and bottom end flaps 34, 58, 14. Alternative loading and closing steps may be used without departing from the scope of this invention.

Figure 3:
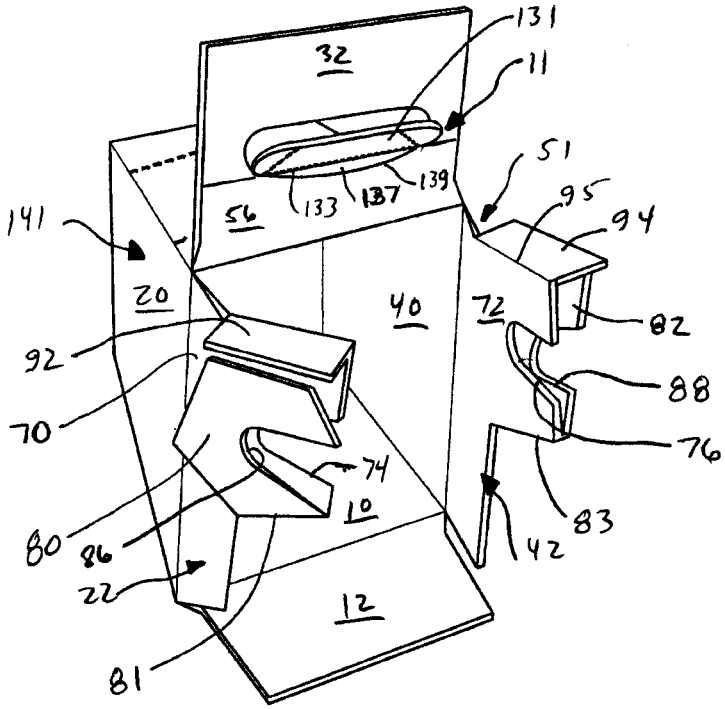
FIG. 3 is a perspective of the carton with the first end further closed.
Figure 4:
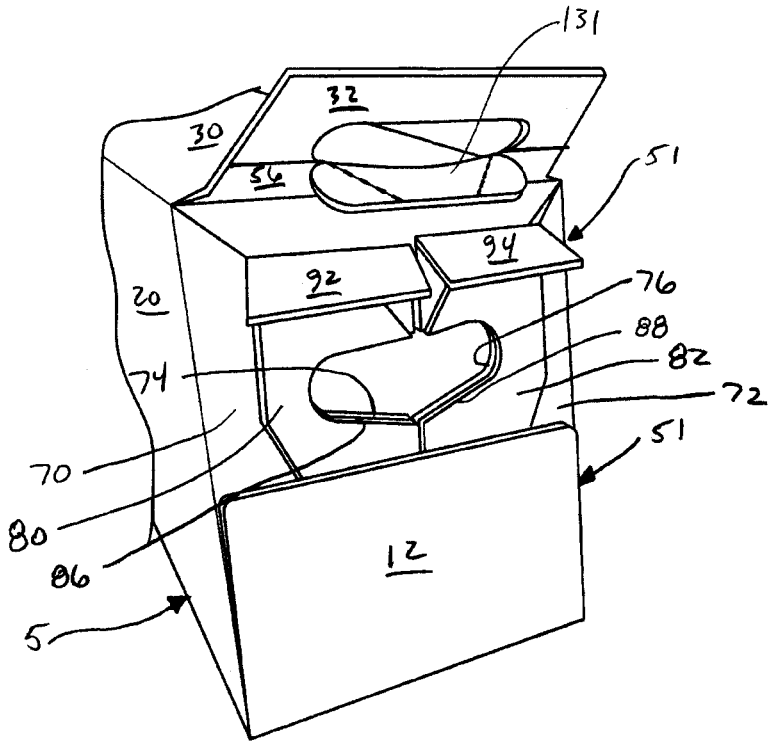
FIG. 4 is a view similar to FIG. 3 but showing the first end of the carton further closed.
Figure 5:
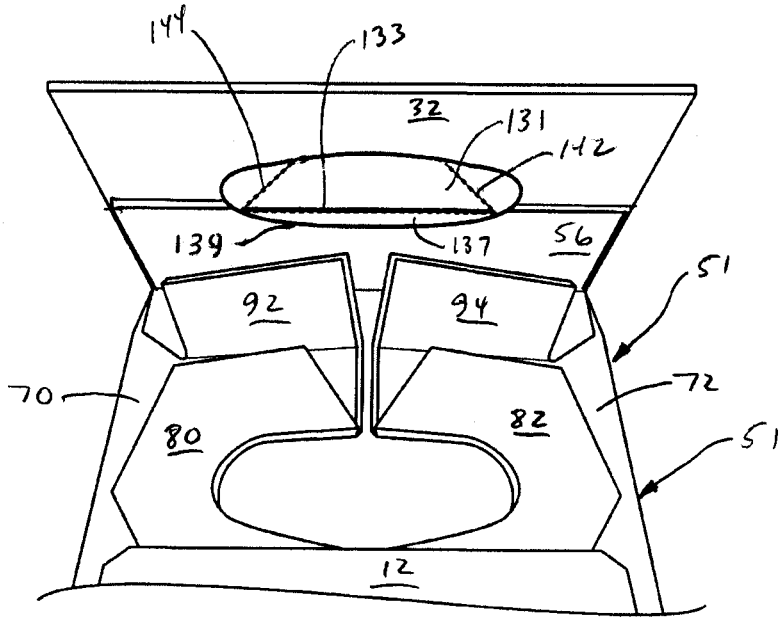
FIG. 5 is an enlarged view showing the first end further closed.
Figure 6:
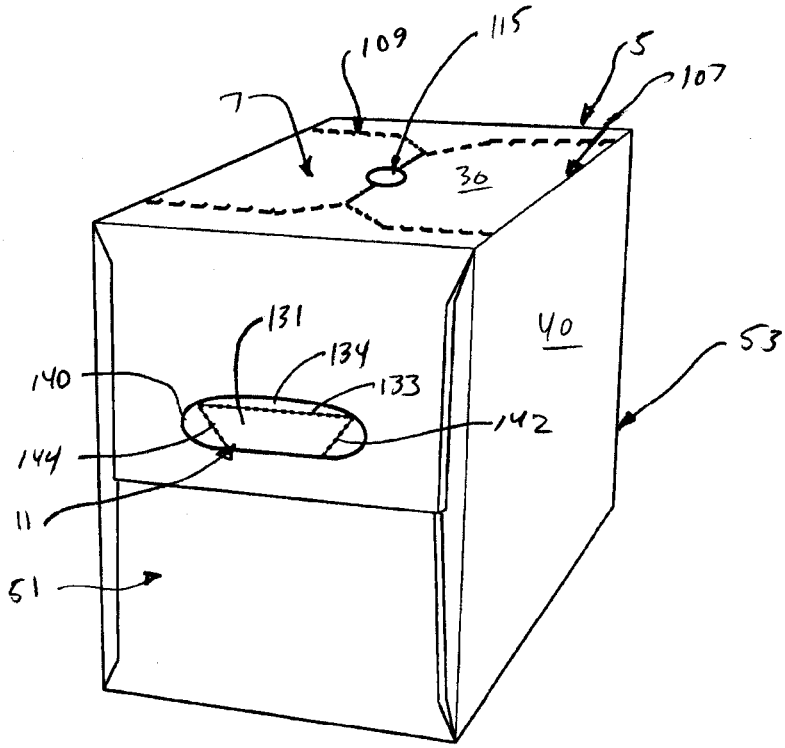
FIG. 6 is a perspective of the carton showing the first end fully closed.

FIGS. 2-6 illustrate the closing of the first end 51 of the carton 5 and the formation of the first handle 11 according to one exemplary method. From the partially assembled position of FIG. 2, the reinforcement panels 80, 82 of the side end flaps 22, 42 are folded upwardly at respective fold lines 81, 83 to be in face-to-face relation with the respective main panels 70, 72 of the side end flaps (FIG. 3). By folding the reinforcement panels 80, 82 upward, the respective cutouts 86, 88 of the reinforcement panels are aligned with the respective cutouts 74, 76 of the main panels 70, 72. As shown in FIG. 4, the first bottom end flap 12 is upwardly folded to further close the first end 51 of the carton. Next, the overlapped top end flaps 56, 32 attached to the first and second top panels 30, 50 are downwardly folded to further close the first end 51 of the carton. As shown in FIG. 6, the overlapped top end flaps 56, 32 contact the extension panels 92, 94 of the side end flaps 22, 42 to fold the extension panels downward along respective lateral fold lines 93, 95 so that the extension panels overlap a portion of the upwardly folded reinforcement panels 80, 82 between the extension panel fold lines and the cutouts 86, 88. The overlapped top end flaps 32, 56 are then further folded downward and secured in the position shown in FIG. 6 so that the handle flap 131 is aligned with the overlapped handle cutouts 86, 88, 74, 76. The upwardly folded reinforcement panels 80, 82 can be secured to the main panels 70, 72 by adhesive such as glue. Further, the downwardly folded extension panels 92, 94 may be secured to the reinforcement panels 80, 82 by adhesive such as glue. The portion of the upwardly folded reinforcement panels 80, 82 above cutouts 86, 88, 74, 76 will typically be in opposing face-to-face contact with a respective portion of the main panels 70, 72 and the downwardly folded extension panels 92, 94. The downwardly folded extension panels 92, 94 will typically be in opposing face-to-face contact with the portion of the upwardly folded reinforcement panels 80, 82 above cutouts 86, 88, 74, 76 and the top end flap 56 that is overlapped and adhered to top end flap 32.

The first handle 11 may be used to grasp the carton 5 by pressing against the elongate handle flap 131 to create the handle opening 139 (FIG. 7) in the closed end 51 of the carton 5. The downwardly folded extension panels 92, 94 and upwardly folded reinforcement panels 80, 82 of the side end flaps 22, 42 provide additional layers of material above the handle opening 139 to reinforce the carton 5 when the carton is lifted at the handle 11. The handle 11 is shaped and positioned in the carton so that multiple fingers of a user may be placed through the handle opening 139 in the overlapped top end flap 32 and side end flaps 22, 42 and the thumb of a user may be placed on the overlapped top panels 30, 50 for grasping and lifting the carton 5. The extension panels 92, 94 increase the strength and rigidity of the carton 5 in the area above the handle 11 to prevent the carton from tearing or otherwise failing when lifted.

The second handle 13 having the same features as the first handle 11 may be formed in the second end 53 of the carton in a similar manner as the first handle. The second handle 13 is similarly reinforced by the features of the handle to prevent the carton 5 from tearing or otherwise failing when the carton is grasped and lifted by the second handle.

In the illustrated embodiment, the second handle 13 of the carton 5 includes features substantially similar to the handle 11. For ease of illustration, the features of the second handle 13 are indicated with the same reference numbers as the features of the first handle 11. The second handle 13 is assembled in a similar manner as the first handle 11 in that the handle is formed in overlapped end flaps 14, 24, 34, 44, and 58 in the second end 53 of the carton 5.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for containing a plurality of articles, the carton comprising:

a plurality of panels that extend at least partially around an interior of the carton, the plurality of panels comprise a top panel, a bottom panel, a first side panel, and a second side panel;

end flaps respectively foldably attached to respective panels of the plurality of panels, wherein the end flaps are overlapped with respect to one another and thereby at least partially form a closed end of the carton, the end flaps comprising at least one side end flap foldably attached to one of the first side panel and the second side panel, a top end flap foldably attached to the top panel, and a bottom end flap foldably attached to the bottom panel; and a handle in the closed end of the carton having a handle opening for grasping and carrying the carton, the at least one side end flap comprises a main panel for at least partially closing the closed end of the carton, a reinforcement panel foldably attached to the main panel and upwardly folded relative to the main panel to at least partially overlap the main panel, and an extension panel foldably attached to the main panel, the reinforcement panel cooperating with the main panel to form the handle;

the reinforcement panel is in face-to-face contact with an exterior surface of the main panel and an interior surface of the bottom end flap, and the extension panel is in face-to-face contact with the reinforcement panel and an interior surface of the top end flap.

2. The carton of claim 1 wherein the at least one side end flap comprises a first side end flap foldably attached to the first side panel and a second side end flap foldably attached to the second side panel.

3. The carton of claim 2 wherein each of the first and second side end flaps comprises a respective main panel and a respective reinforcement panel.

4. The carton of claim 3 wherein the handle comprises a handle cutout in the reinforcement panel of the first side end flap and a handle cutout in the reinforcement panel of the second side end flap.

5. The carton of claim 4 wherein the handle comprises a handle cutout in the main panel of the first side end flap and a handle cutout in the main panel of the second side end flap, the respective handle cutouts of the two end flaps cooperate to form the handle opening.

6. The carton of claim 5 wherein the handle comprises a handle flap foldably attached to the top end flap and substantially aligned with the handle cutouts to form the handle opening, the handle flap being inwardly folded extending through the handle cutout of the main panel of the first side end flap and the handle cutout of the handle cutout of the main panel of the second side end flap, and being in face-to-face contact with the interior surface of the main panel of the first side end flap and the interior surface of the main panel of the second side end flap.

7. The carton of claim 1 wherein the extension panel is downwardly folded.

8. The carton of claim 7 wherein at least one of the extension panel and the reinforcement panel is secured to the main panel.

9. The carton of claim 1 wherein:

the closed end is a first closed end;

the end flaps are first end flaps that are overlapped with respect to one another to form the first closed end; and the carton further includes at least two second end flaps respectively foldably attached to respective panels of the plurality of panels, wherein the second end flaps are overlapped with respect to one another to at least partially form a second closed end of the carton.

10. The carton of claim 9 wherein the handle is a first handle and the carton further comprises a second handle in the second closed end.

11. The carton of claim 1 in combination with a plurality of articles, the plurality of articles comprising bottles that are arranged in an upright position in the carton.

12. The carton of claim 1, wherein the main panel of the at least one side end flap is foldably attached to one of the first side panel and the second side panel.

13. The carton of claim 1, wherein the extension panel is attached to the main panel at an upper fold line that is above the handle, and the reinforcement panel is attached to the main panel at a lower fold line that is below the handle.

14. The carton of claim 1 wherein the reinforcement panel is in face-to-face contact with the interior surface of the top end flap.

15. A blank for forming a carton comprising:

a plurality of panels comprising a top panel, a bottom panel, a first side panel, and a second side panel;

end flaps respectively foldably attached to respective panels of the plurality of panels, the end flaps comprising at least one side end flap foldably attached to one of the first side panel and the second side panel, a top end flap foldably attached to the top panel, and a bottom end flap foldably attached to the bottom panel; and features in the at least two end flaps, wherein the features are for cooperating to at least partially define a handle opening in a carton erected from the blank, the at least one side end flap comprises a main panel for at least partially closing an end of the carton erected from the blank, a reinforcement panel foldably attached to the main panel, the reinforcement panel being positioned for upwardly folding relative to the main panel to at least partially overlap the main panel, and an extension panel foldably attached to the main panel, the reinforcement panel and the main panel having respective features for at least partially forming the handle, the reinforcement panel being for positioning in face-to-face contact with an exterior surface of the main panel and an interior surface of the bottom end flap in the carton formed from the blank, and the extension panel being for positioning in face-to-face contact with the reinforcement panel and an interior surface of the top end flap.

16. The blank of claim 15 wherein the extension panel is for being downwardly folded by engagement with the top end flap when the carton erected from the blank is closed.

17. The blank of claim 16 wherein the extension panel is discontiguous with the feature in the main panel that is for at least partially defining the handle.

18. The carton of claim 16, wherein the extension panel is attached to the main panel at an upper fold line that is above the feature in the main panel that is for at least partially defining the handle, and the reinforcement panel is attached to the main panel at a lower fold line that is below the feature in the main panel that is for at least partially defining the handle.

19. The blank of claim 15 wherein the at least one side end flap comprises a first side end flap foldably attached to the first side panel and a second side end flap foldably attached to the second side panel.

20. The blank of claim 19 wherein each of the first and second side end flaps comprises a respective main panel and a respective reinforcement panel and the features comprise respective handle cutouts in the main panel of each of the first side end flap and the second side end flap, respective handle cutouts in the reinforcement panel of each of the first side end flap and second side end flap, and a handle flap foldably attached to the top end flap for forming the handle opening.

21. The blank of claim 15, wherein the main panel of the at least one side end flap is foldably attached to one of the first side panel and the second side panel.

22. A method of assembling a carton comprising:

obtaining a carton comprising a top panel, a bottom panel, a first side panel, and a second side panel, at least one side end flap foldably attached to at least one of the side panels at a first end of the carton, at least one top end flap foldably attached to the top panel at the first end, and a handle formed at least in part in the at least one top end flap and the at least one side end flap, the at least one side end flap comprising a main panel for at least partially forming a closed end of the carton, a reinforcement panel foldably attached to the main panel, and an extension panel foldably attached to the main panel;

folding the at least one side end flap to at least partially close the first end of the carton;

upwardly folding the reinforcement panel to at least partially overlap the main panel of the side end flap during the at least partially closing of the first end to at least partially form the handle, the reinforcement panel being positioned in face-to-face contact with an exterior surface of the main panel;

downwardly folding the top end flap to contact the extension panel to fold the extension panel downward to be in face-to-face contact with the reinforcement panel; and securing the at least one top end flap in a downwardly folded position to at least partially form the closed first end of the carton.

23. The method of claim 22 further comprising securing the reinforcement panel to the main panel.

24. The method of claim 23 further comprising securing the extension panel to the reinforcement panel.

25. The method of claim 22 wherein the at least one side end flap comprises two side end flaps.

26. The method of claim 25 wherein the handle comprises a handle flap foldably attached to the at least one top end flap and respective handle cutouts in each of the main panel and the reinforcement panel of the two side end flaps, and the method further comprises folding the handle flap into the handle cutouts to form a handle opening of the carton.

27. The method of claim 22 wherein the carton further comprises a plurality of end flaps at the second end of the carton and the method further comprises overlapping the plurality of end flaps at the second end to at least partially close the second end of the carton.

28. The method of claim 22 wherein the carton comprises a bottom end flap foldably attached to the bottom panel at the first end, the method further comprises upwardly folding the bottom end flap to contact the reinforcement panel to initiate the upwardly folding of the reinforcement panel.

29. The method of claim 28 wherein the upwardly folding of the bottom end flap positions the reinforcement panel in face-to-face contact with an interior surface of the bottom end flap.

* * * * *